US007677187B2

(12) United States Patent
Terao et al.

(10) Patent No.: US 7,677,187 B2
(45) Date of Patent: Mar. 16, 2010

(54) PATTERN GENERATING MECHANISM FOR SEWING MACHINE

(75) Inventors: Akira Terao, Ama-gun (JP); Shin Ota, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 690 days.

(21) Appl. No.: 11/653,356

(22) Filed: Jan. 16, 2007

(65) Prior Publication Data

US 2007/0193485 A1 Aug. 23, 2007

(30) Foreign Application Priority Data

Jan. 27, 2006 (JP) ..... 2006-018684

(51) Int. Cl.
*D05B 3/06* (2006.01)
*D05B 3/02* (2006.01)
*D05B 69/02* (2006.01)

(52) U.S. Cl. ..... 112/466; 112/448; 112/65

(58) Field of Classification Search ..... 112/65–67, 112/446–466
See application file for complete search history.

(56) References Cited

U.S. PATENT DOCUMENTS 3,724,404 A * 4/1973 Marsh et al. ..... 112/460
4,084,523 A * 4/1978 Kasuga ..... 112/444
4,084,524 A * 4/1978 Hasegawa ..... 112/449
4,216,731 A * 8/1980 Yazawa ..... 112/444
4,368,681 A * 1/1983 Hanyu et al. ..... 112/462
4,428,311 A 1/1984 Sano
4,643,120 A * 2/1987 Hanyu et al. ..... 112/466
4,658,744 A * 4/1987 Takauchi et al. ..... 112/466
4,691,655 A * 9/1987 Sano ..... 112/466

FOREIGN PATENT DOCUMENTS

| | | |
|---|---|---|
| JP | Y2 61-42526 | 12/1986 |
| JP | B2 62-14316 | 4/1987 |
| JP | B2 62-26796 | 6/1987 |
| JP | Y 1-23432 | 7/1989 |
| JP | A 2006-012284 | 1/2006 |

* cited by examiner

*Primary Examiner*—Ismael Izaguirre
(74) *Attorney, Agent, or Firm*—Oliff & Berridge, PLC

(57) ABSTRACT

A button-hole earn is mounted on a pattern selection cam shaft for mounting a pattern selection cam, the pattern selection cam shaft provided independently of a pattern cam shaft provided with a needle swing cam group. The rotation of a sewing machine main shaft causes rotation of a drive gear which in turn rotates a first follower gear in engagement with the drive gear and a second follower gear engaged with the first follower gear. Thus, the rotation of the first follower gear causes rotation of the needle swing cam group whereas the rotation of the second follower gear causes rotation of the button-hole cam. Thus, a pattern selected among a plurality of patterns by a pattern selection dial is generated to form button-hole stitches selected by the pattern selection dial.

7 Claims, 8 Drawing Sheets

PATTERN GENERATING MECHANISM FOR SEWING MACHINE

This application is based upon and claims the benefit of priority from the prior Japanese Patent Application 2006-018684, filed on, Jan. 27, 2006 the entire contents of which are incorporated herein by reference.

FIELD

The present disclosure is directed to a sewing machine for forming stitch patterns by a cam mechanism and particularly to a pattern generating mechanism of a sewing machine capable of selectively executing zigzag utility pattern sewing and button hole sewing.

BACKGROUND

Utility pattern is a concept distinct from embroidery pattern sewing and hereinafter used to include all kinds of patterns deriving from a zigzag stitch pattern. Further, a pattern includes a pattern formed by stitches and may occasionally be referred to as a stitch pattern. Also, left, right front and rear denotes a relative direction having their basis on the forward direction relative to the user which is defined as the front direction.

Conventionally, a machine-driven pattern generating mechanism having a plurality of utility-pattern needle swing cams and a plurality of feed cams is arranged to bring a contact in abutment with the needle swing cam and the feed cam of the intended pattern by manually rotating a pattern selection dial. Thus, the machine-driven pattern generating mechanism generates stitch patterns by a combination of needle swing operation and cloth feed operation rendered by mechanical operation of each relevant component to form the desired utility pattern on the workpiece cloth. Nowadays, various types of pattern generating mechanisms have been suggested which are capable of button-hole sewing in addition to forming ordinary utility patterns.

For example, Japanese patent document 1, more specifically, JP-S62-014316 B (pages 4 to 5 and FIGS. 1 and 3) describes a button-hole forming unit of a zigzag sewing machine having a utility-pattern pattern cam, automatic feed cam and feed control cam for button-holes, and a worm wheel which are formed integrally on a cam shaft of a sewing machine arm. When button hole sewing is selected by rotating the pattern selection dial, feed amount of a feed regulator is controlled by a swinging movement of a feed contact and a needle bar is swung by a swinging movement of a swing-width contact so as to form button hole stitches constituted by a set of side-stitch portions in the left and right and bar-tack portions in the front and rear.

The button hole forming unit of the zigzag sewing machine described in patent document 1 has the utility-pattern pattern cam and the button-hole cam provided integrally on a cam shaft so as to be adjacent one another. This leads to increase in the axial dimension of the cam which in turn requires larger axial space and consequently enlarging the sewing machine.

Normally, a pattern cam for utility patterns employ 18-division pattern cam, and small-size household sewing machines employ 12-division pattern cams to achieve compactness at the expense of number of sewable patterns. However, fully automatic button hole stitching requires 6 stitches for each front and rear bar-tack portion and 3 stitches for each left and right side-stitch portions amounting to a total of 18 stitches, thus in need of a 18-division button-hole cam.

Also, as described in patent document 1, since the pattern cam and the button-hole cam are rotated in synchronism, the pattern cam for utility patterns needs to bear 18-divisions for adjustment with 18 stitches of the fully automatic button-hole stitching.

Other related art such as U.S. Pat. No. 4,428,311 (FIG. 6 and the corresponding description) describes a pattern selection mechanism of a sewing machine having a pattern cam shaft 21 provided in an arm so as to be perpendicular to a main shaft 20 and an operation shaft 30 parallel to the pattern cam shaft 21. The pattern cam shaft 21 has a first cam group 24 (for example pattern cam group) provided thereto while the operation shaft 30 has a second cam group 32 and a selection cam 33 and the pattern cam shaft 21 has a gear 26 provided thereto. The operation shaft 30 also has a gear 31 pivotally supported thereto.

While the gears 26 and 31 establish an engagement, the gear 26 is engaged with a worm wheel 19 which also establishes engagement with worm 23 secured to the main shaft 20. A first reduction mechanism composed of the worm 23 and the gear 26 has a reduction ratio of 1/6 and the reduction ratio of a second reduction mechanism composed of the first reduction mechanism and the gears 26 and 31, amounts to the total reduction ratio of 1/12.

The structure disclosed in patent document 2 enables the cam shaft and the operation shaft to be shortened, allowing size reduction of the sewing machine. Moreover, since the rotation times of the cam shaft and the operation shaft can be modified, if a button-hole cam is applied to the second cam group, the number of division of the pattern shaft provided the cam shaft and the number of division of the button-hole cam provided on the operation shaft may vary depending on the reduction ratio.

The pattern selection mechanism of the sewing machine described in patent document 2 is arranged to modify the reduction ratio between the pattern cam shaft 21 and the gear 26 on the operation shaft. Thus, the number of stitches (number of divisions) for ordinary utility patterns and the number of stitches (number of divisions) for button-hole stitches can be modified accordingly. However, allowing such modification in reduction ratio requires provision of the above described worm 23, worm wheel 19, and two gears 26 and 31, thereby increasing the number of parts, and moreover enlarging the drive mechanism composed of a cam shaft and an operation shaft, consequently leading to increase in manufacturing cost.

Furthermore, sequential engagement of the worm 23 and worm wheel 19 and the two gears 26, 31 results in increase in number of engagement, which in turn leads to lower transmission efficiency of drive force. Moreover, rattling caused by backlash impairs precision of gear rotation and may cause impairment in precision of rotational positioning of the pattern cam and the button-hole cam.

SUMMARY

An object of the present disclosure is to provide a pattern generating unit of a sewing machine that achieves compactness, less-complexity, low cost, and improvement in precision of rotational positioning of needle swing cam group and button-hole cam.

The pattern generating mechanism of a sewing machine of the present disclosure includes a pattern selection cam mounted on a pattern selection cam shaft for selecting one of a plurality of patterns with a pattern selection dial; a needle swing cam group being mounted on the pattern cam shaft disposed independently of the pattern selection cam shaft and generating needle swinging movement of a needle bar corresponding to a plurality of patterns. The pattern generating mechanism of a sewing machine further includes a drive gear rotated by rotation of the main shaft; a first follower gear engaged with the drive gear to rotate the needle swing cam group; a button-hole cam disposed on the pattern selection cam shaft supporting the pattern selection cam and a second follower gear disposed on the pattern selection cam shaft and engaging with the first follower gear to rotate the button-hole cam.

The pattern generating mechanism of the sewing machine operates as follows. The rotation of the sewing machine main shaft causes rotation of the drive gear which in turn rotates the first follower gear in engagement with the drive gear and a second follower gear engaged with the first follower gear. The rotation of the first follower gear causes rotation of the needle swing cam group whereas the rotation of the second follower gear causes rotation of the button-hole cam. Thus, a pattern selected among a plurality of patterns by the pattern selection dial is generated in the form of a mechanical motion which mechanical motion is ultimately transmitted to the needle swing mechanism and the cloth feed mechanism to form button-hole stitches in accordance with a pattern selected by the pattern selection dial.

According to the above construction, the button-hole cam is not provided co-axially with the needle swing cam group disposed on the pattern cam shaft, but is disposed on a pattern selection cam shaft provided with a compact pattern selection cam. The achievement of a compact pattern generating mechanism is attributable to such construction.

In one preferable aspect, a worm gear is employed for the aforementioned drive gear, a worm wheel for the first follower gear, and a helical gear for the second follower gear. In another aspect, the reduction ratio of the first reduction mechanism composed of the drive gear and the first follower gear is set to 1/12, whereas the reduction ratio of the second reduction mechanism composed of the drive gear and the first and the second follower gears amounts to the total reduction ratio of 1/18. Also, the drive gear, the first follower gear and the second follower gear are disposed in the listed sequence so as to assume a substantially linear disposition.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE PREFERRED EMBODIMENT

The pattern generating mechanism of a sewing machine of the present disclosure has a button-hole cam for forming a button-hole stitch. The button-hole cam is disposed on a pattern selection cam shaft supporting a pattern selection cam. The pattern generating mechanism rotates a needle swing cam group by a first follower gear which is rotated by a worm gear, and the first follower gear rotates a second follower gear which in turn rotates the button-hole cam.

Figure 1:
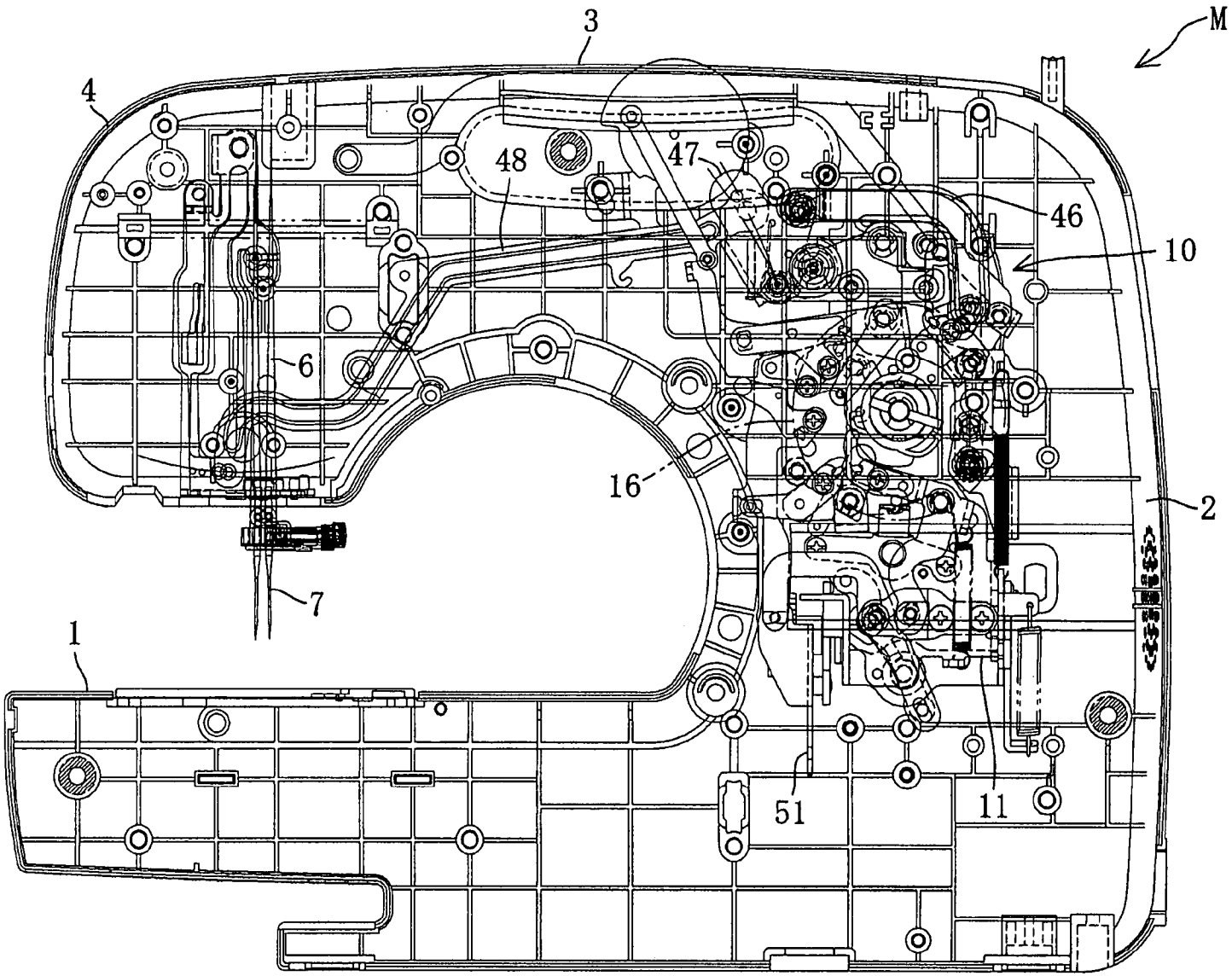
FIG. 1 is a front view of a vertical section of a main portion of a household sewing machine employed in one illustrative aspect.

Referring to FIG. 1, a house hold sewing machine M includes a bed 1 having a horizontal bed surface; a foot 2 standing on the right end of the bed 1; an arm 3 extending leftward form the upper portion of the foot 2 so as to confront the bed 1; and a head 4 provided at the left end of the arm 3. The arm 3 has a sewing machine main shaft 5 (refer to FIG. 2) driven by a sewing machine motor not shown disposed therein.

The head 4, as well know in the field of sewing machines, is provided with a vertically movable needle bar 6 and thread take-up; a thread tension regulator for controlling thread tension of a needle thread; a needle bar vertically moving mechanism vertically moving a needle bar 6; a needle swing mechanism swinging the needle bar 6; and a thread take-up drive mechanism vertically swinging the thread take-up. The needle bar 6 has a sewing needle 7 attached to the lower end thereof.

Provided in the bed 1 is a rotary hook driven by a lower shaft 8 (refer to FIG. 2) rotated in synchronism with the sewing machine main shaft 5; and a feed regulator, or the like, that controls the amount of cloth feed rendered by a feed dog. The feed regulator is connected to a feed activating lever 51 of the later described pattern generating mechanism 10. The rotary hook and the feed regulator employed in this case are equivalents of those well known in the field of sewing machines.

As shown in FIG. 1, a pattern generating mechanism 10 that generates a plurality of utility patterns is vertically disposed as a unit inside the foot 2. The unitized pattern generating mechanism 10 will be described with reference to FIGS. 1 to 5.

A longitudinally oriented pattern selection cam shaft 12 is rotatably supported by a vertically extending unit frame 11 taking on a plate form. More specifically the pattern selection cam shaft 12 is supported at a portion slightly above the lengthwise mid-portion of the unit frame 11. The pattern selection cam shaft 12 has a pattern selection cam 13 secured thereto. The pattern selection cam 13 is used for selecting one desired pattern among a plurality of, for instance, twelve utility patterns.

The pattern selection cam 13 is made of synthetic resin and is formed as a face cam having a selection cam surface 13*a* shaped so as to be capable of maintaining a pattern selection contact 14 at a selected position. The pattern selection dial 16 is detachably secured to the pattern selection cam shaft 12 from the exterior of the foot 2. The pattern selection dial 16 allows selection of a pattern by being rotated by the user.

Figure 10:
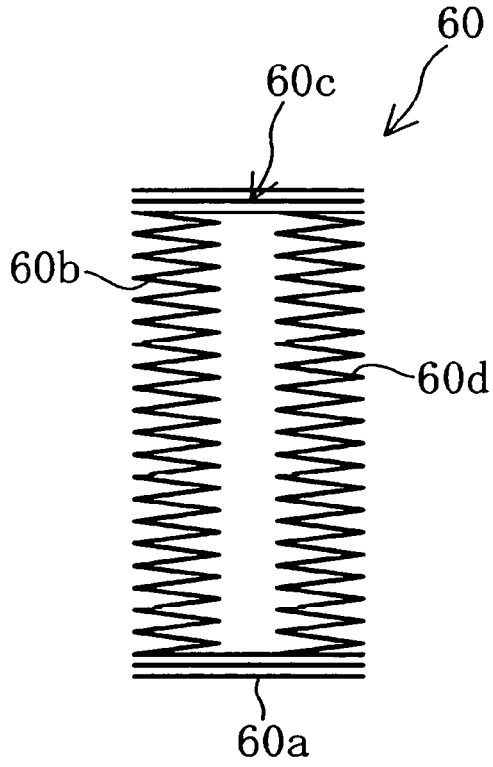
FIG. 10 is a plan view of a button-hole stitch.

A button-hole cam 18 is provided rotatably in the rear side of the pattern selection cam shaft 12 for forming a later described button-hole stitch 60 (FIG. 10). Also, in the rear side of the button-hole cam 18, a second follower gear 20 made of helical gear is rotatably supported by the pattern selection cam shaft 12.

The pattern cam shaft 21 is independent of the pattern selection cam shaft 12 and is disposed below the pattern selection cam shaft 12 so as to be parallel therewith. The front end of the pattern cam shaft 21 is secured to the unit frame 11. A needle swing cam group 22 composed of a plurality of needle swing cams 22*a* for utility patterns is mounted rotatably on the pattern cam shaft 21. As well known in the art, a needle swing contact 23 is provided rotatably about a guide shaft 23*a* and movably in the shaft direction thereof so as to confront either of the needle swing cams 22*a* of the needle swing cam group 22. The needle swing contact 23 is arranged to move conjunctively with the pattern selection contact 14, thus, when the pattern selection cam 13 is rotated by the pattern selection dial 16, the pattern selection contact 14 is moved along the selection cam surface 13*a* of the pattern selection cam 13. The needle swing contact 23 is moved along the shaft direction of the guide shaft 23*a* by the movement of the pattern selection contact 14 and is placed in contact with the needle swing cam 22*a* corresponding to the single utility pattern selected by the pattern selection dial 16.

The first follower gear 25 composed of a worm wheel is formed integrally to the rear side of the needle swing cam group 22.

A pair of left and right support portions 11*a* and 11*b* is formed respectively at the lower end of the unit frame 11 below the first follower gear 25. A laterally oriented rotary shaft 26 is supported rotatably by the support portions 11*a* and 11*b* and a drive gear 27 composed of a worm gear is secured at the lateral center of the rotary shaft 26 whereas a first follower pulley 28 is secured at the left end of the rotary shaft 26.

The drive gear 27 is engaged with first follower gear 25 immediately there above and the first follower gear 25 is engaged with the second follower gear 20 immediately above the first follower gear 25. That is, the drive gear 27, the first follower gear 25, and the second follower gear 20 are vertically arranged in the listed sequence in a substantially linear disposition.

Figure 2:
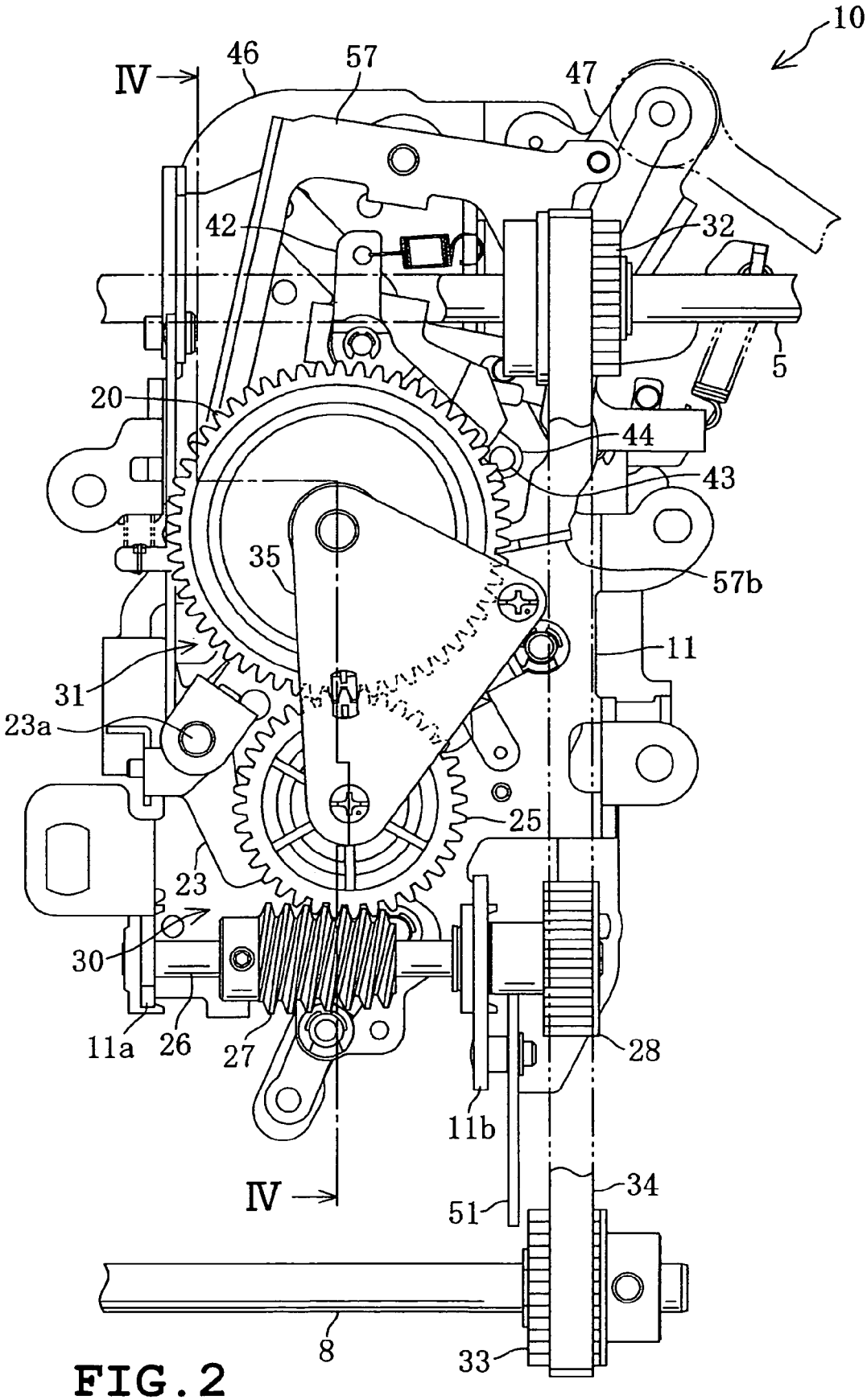
FIG. 2 is a rear view of a pattern generating mechanism in accordance with the illustrative aspect.

Referring to FIG. 2, the sewing machine main shaft 5 is disposed inside the arm 3 in alignment with the lengthwise direction thereof and the lower shaft 8 is disposed inside the bed 1 so as to be parallel with the sewing machine main shaft 5 as in a well known sewing machine. A drive pulley 32 is secured to a portion of the sewing machine main shaft 5 and a second follower pulley 33 is secured to the lower shaft 8. A timing belt 34 is wound on the drive pulley 32, the first follower pulley 28 and the second follower pulley 33, and the drive gear 27 and the lower shaft 8 are rotated in synchronism at the same speed by the sewing machine main shaft 5 via the timing belt 34.

The rear ends of the pattern selection cam shaft 12 and the pattern cam shaft 21 are supported by a substantially triangle support plate 35 disposed in the rear side thereof. Thus, relative positioning between the cam shafts 12 and 21 are steadily maintained and moreover, the engagement between the first follower pulley 28 and the second follower pulley 33 are maintained with stability.

The reduction ratio of the first reduction mechanism 30 composed of the drive gear 27 and the first follower gear 25 is set at 1/12, whereas the reduction ratio of the second reduction mechanism 31 composed of the first reduction mechanism 30 and the first and the second follower gears amounts to a total of 1/18. That is, twelve rotations of the sewing machine main shaft 5 corresponding to twelve stitches, in other words, twelve rotations of the drive gear 27 renders one rotation of the first follower gear 25 and the needle swing cam group 22 connected thereto. Also, eighteen rotations (eighteen rotations of the drive gear 27) of the sewing machine main shaft 5 corresponding to eighteen stitches renders one rotation of the second follower gear 20 and the button-hole cam 18 operating conjunctively therewith.

Figure 4:
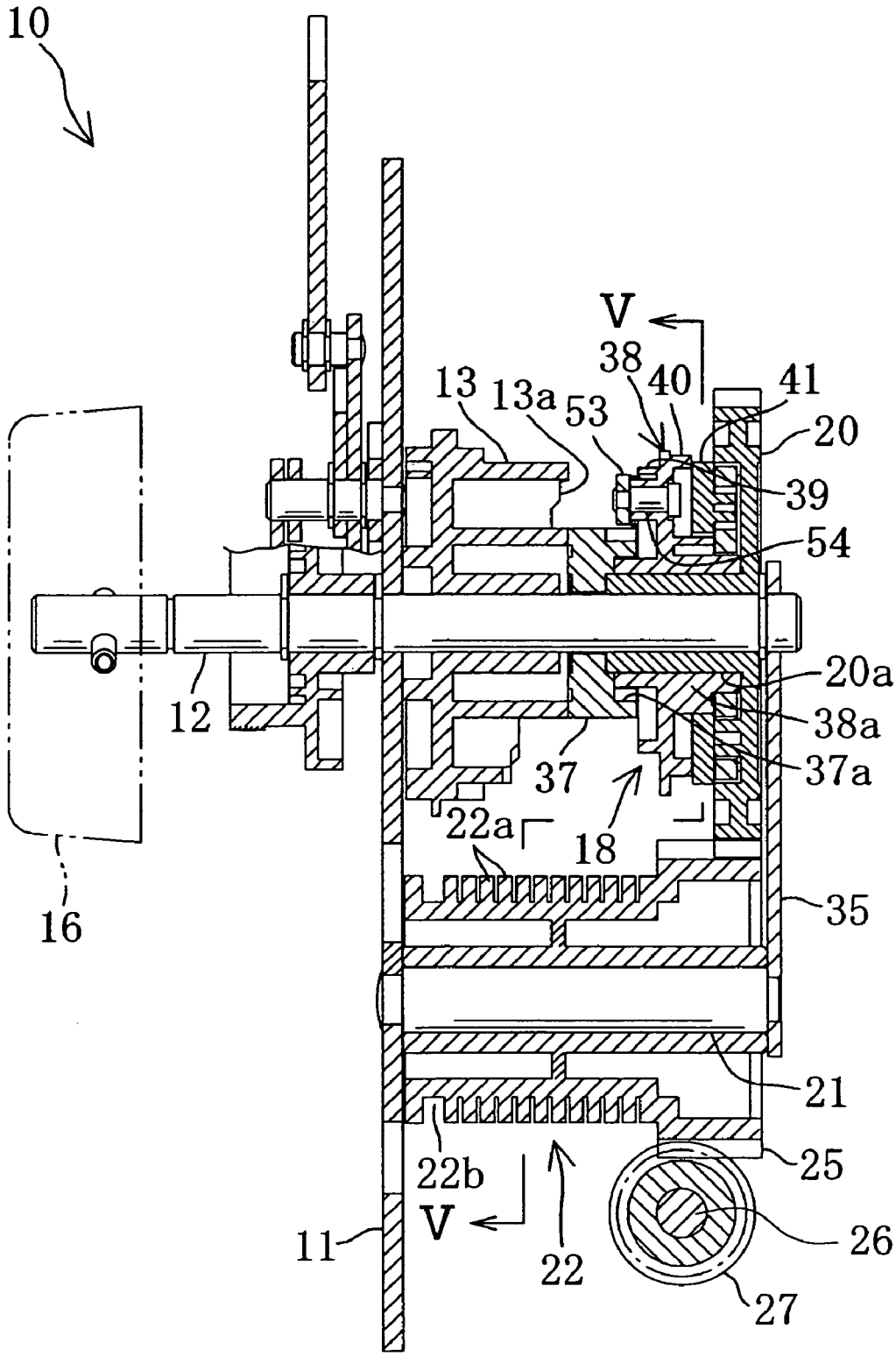
FIG. 4 is a vertical sectional side view taken along line IV-IV in FIG. 2.

A description will be given on the button-hole cam 18 hereinafter. Referring to FIG. 4, the button-hole cam 18 includes a combination cam 38 (refer to FIGS. 8 and 9) integrally formed with a clutch cam 37 having a plurality of clutch grooves 37*a* defined thereto, a feed control cam 39, and a first needle swing control cam 40 for sewing bar-tack portions 60*a* and 60*c*; and a second needle swing control cam 41 for sewing the over-edging portions 60*b* and 60*d* in the left and right sides, and the foregoing are arranged to be rotated by the second follower gear 20.

The combination cam 38 is rotatable about a cylindrical portion 20*a* of the second follower gear 20 and the rotation of the second follower gear 20 is transmitted thereto to be rotated integrally with second needle swing control cam 41 only when the clutch operation of the clutch cam 37 is ON. Among the feed control cam 39 and the first needle swing control cam 40, the first needle swing control cam 40 has a center thereof slightly eccentric with respect to a shaft center C of the pattern selection cam shaft 12. Such eccentricity enables the center position of needle swing to be switched between two over-edging portions 60*b* and 60*d* (refer to FIG. 8) in the left and right within the button-hole stitch 60.

Figure 9:
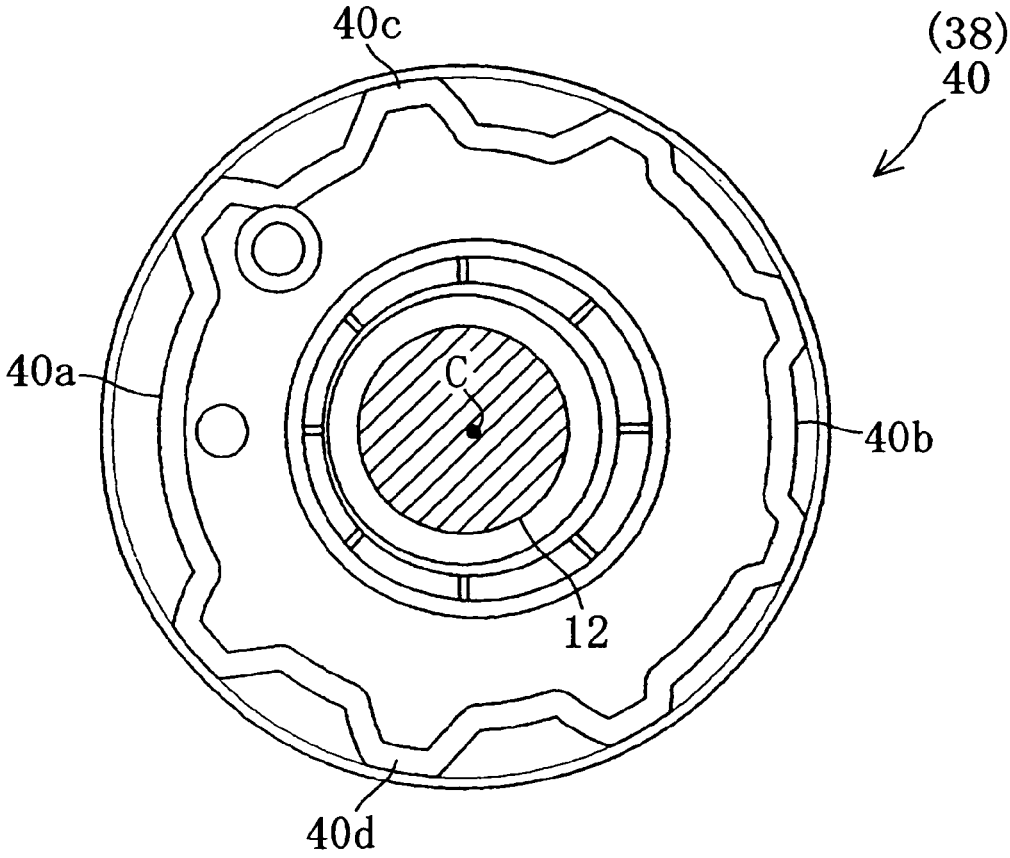
FIG. 9 is a front view of a first needle swing control cam.

Referring to FIG. 9, the first needle swing control cam 40 has a pair of swing-width halving cam surfaces 40*a* and 40*b* contributing to the formation of the left and right over-edging portions 60*b* and 60*d* situated in the left and right sides of the button-hole stitch 60. The swing-width halving cam surfaces 40*a* and 40*b* are positioned so as to be displaced from each other by 180°.

Distance of the swing-width halving cam surface 40*a* from the rotational center C (refer to FIG. 9) of the first needle swing control cam 40 is shorter than the same for the swing-width halving cam surface 40*b* due to the eccentricity. Further, defined between the pair of swing-width cam surfaces 40*a* and 40*b* in the outer periphery of the first needle swing control cam 40 are first and second bar-tack cam surfaces 40*c* and 40*d* assuming repetitive convex-concave profile for forming the front and rear bar-tack portions 60*a* and 60*c*.

Figure 5:
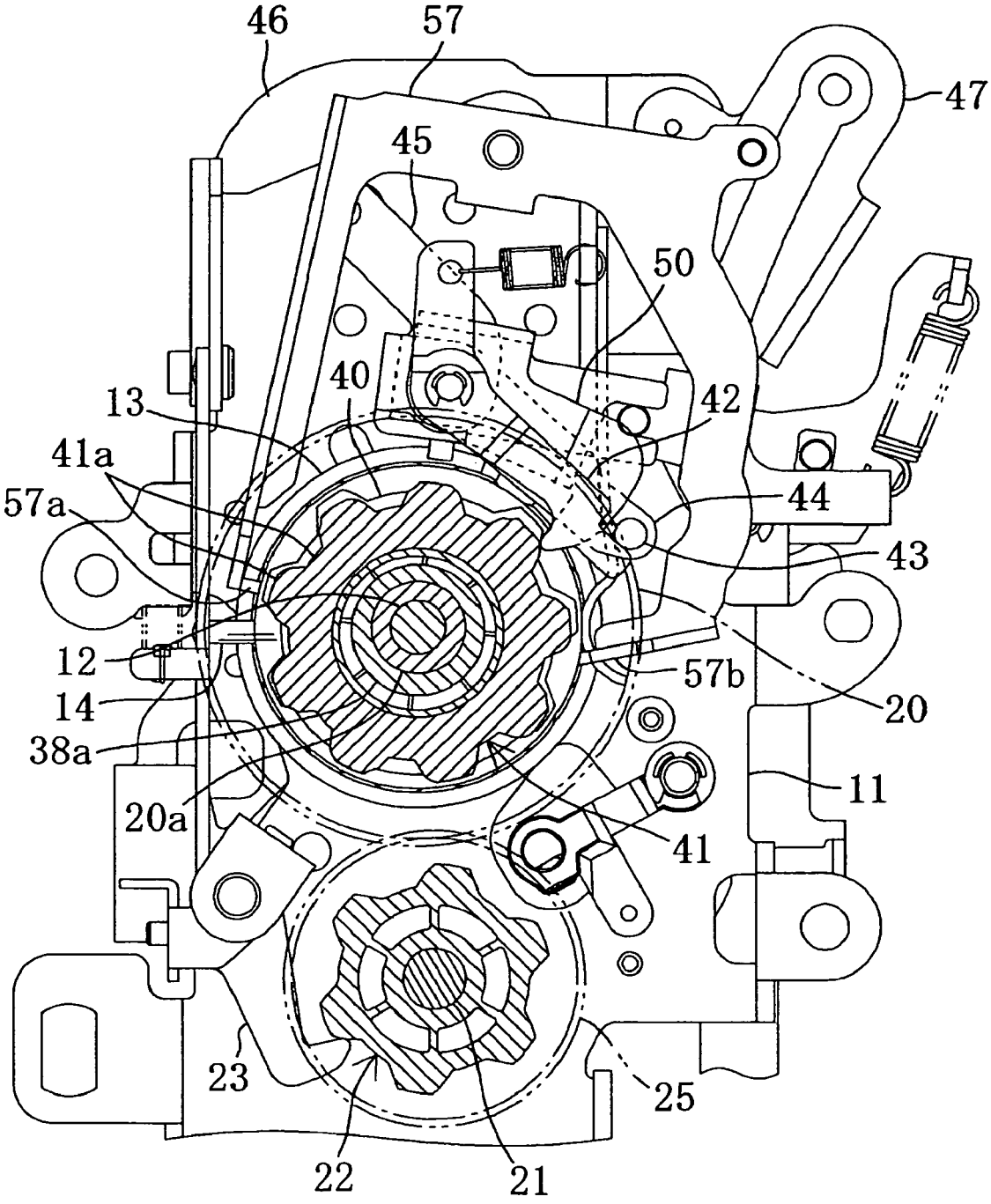
FIG. 5 is a vertical sectional rear view taken along line V-V in FIG. 4.
Figure 6:
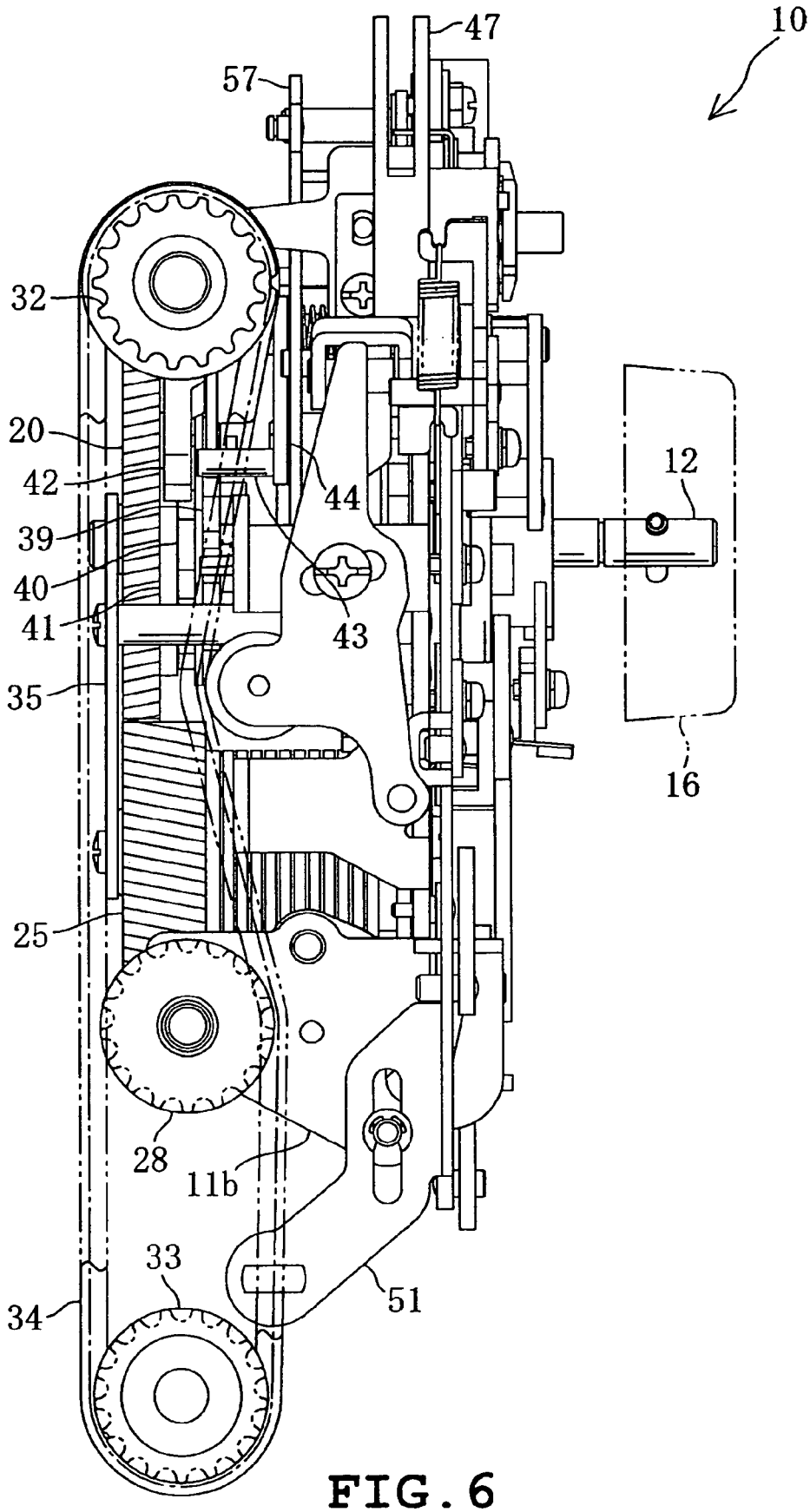
FIG. 6 is a left side view of the pattern generating mechanism.
Figure 7:
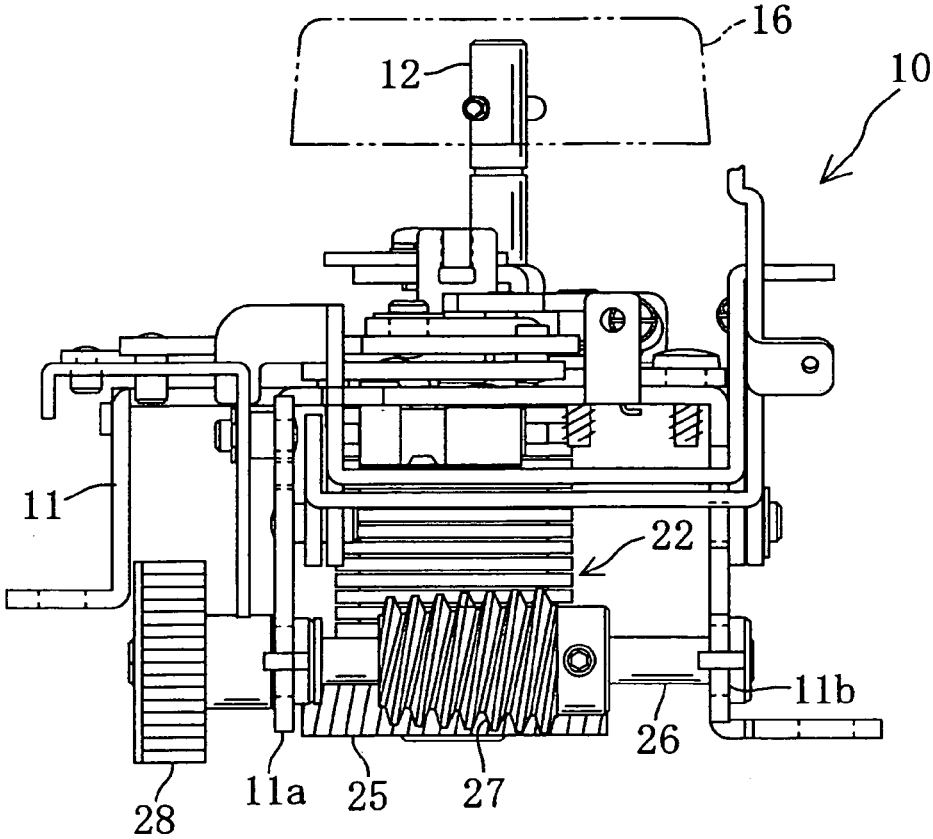
FIG. 7 is a bottom view of the pattern generating mechanism.

Referring to FIG. 5, the second needle swing control cam 41 has, in the outer periphery thereof, a cam surface 41*a* composed of a plurality of convex-concave that act on left and right over-edging portions 60*b* and 60*d* of the button hole stitch 60 in cooperation with the swing-width halving cam surfaces 40*a* and 40*b* of the first needle swing control cam 40.

The convex and concave of the cam surface 41*a* of the second needle swing control cam 41 and the convex and concave of the first and the second bar-tack cam surfaces 40*c* and 40*d* are arranged to substantially match when confronting each other in the shaft direction.

Referring to FIGS. 4 and 5, a button-hole needle swing contact 42 subject to consistent elastic bias is disposed so as to be engaged with the first needle swing control cam 40 and the second needle swing control cam 41. The needle swing contact 42 is arranged to follow the relative change taken by the swing-width halving cam surfaces 40*a* and 40*b* and the first and the second cam surfaces 40*c* and 40*d* of the first needle swing control cam 40 and the cam surface 41*a* of the second needle swing control cam 41. The relation between the first and second needle swing control cams 40 and 41 and the positioning of the needle swing contact therewith follow the conventions of a well known sewing machine of the same type.

The swing of the needle swing contact 42 is transmitted to a needle swing lever 44 via a link pin 43 and the swing of the needle swing lever 44 is in turn transmitted to a swing lever 47 and a needle swing rod 48 (refer to FIG. 1) via a plurality of link levers 45 and 46. Thus, the needle bar 6 is laterally swung by the aforementioned needle swing mechanism. The arrangement in which the swing of the needle swing contact 42 is ultimately transmitted to the needle swing rod 48 and the relation between the needle swing rod 48 and the needle swing mechanism follow the convention of well known sewing machines of the same type.

The cam surface 13*a* of the pattern selection cam 13 is defined so that the needle swing contact 23 is moved in the shaft direction of the pattern camshaft 21 to be positioned at a recess cam 22*b* (refer to FIG. 4) which does not establish any contact with needle swing contact 23 when button-hole sewing is selected by the pattern selection dial 16. Thus, the needle swing contact 23 does not swing when a button-hole selection position is taken and only the swing of the needle swing contact 42 by the first and the second needle swing control cams 40 and 41 are transmitted to the needle swing mechanism.

Figure 8:
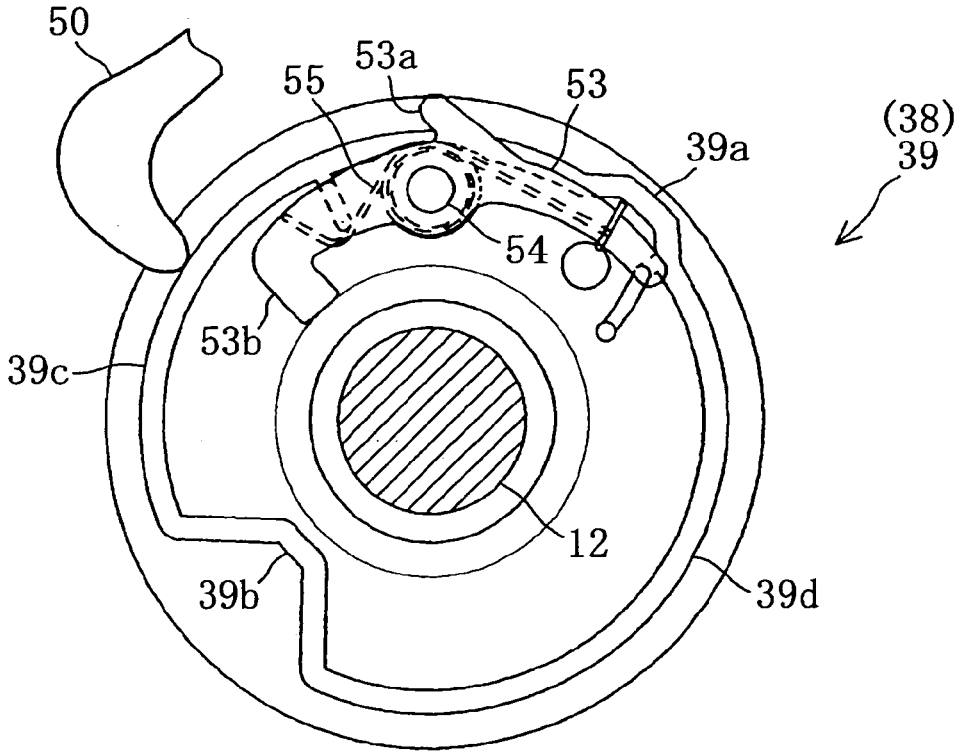
FIG. 8 is a front view of a feed control cam.

As shown in FIG. 8, upon execution of button-hole sewing, a feed control cam 39 controlling the feeding of the feed dog is positioned adjacent to the rear side of the clutch cam 37. The feed control cam 39 has defined thereto a reverse feed cam surface 39*a* that sets a rearward feed amount of the left side over-edging portion 60*b* of the button-hole stitch 60; a forward feed cam surface 39*b* that sets a forward feed amount of the right side over-edging portion 60*d*; and a first bar-tack cam surface 39*c* that sets a zero feed amount at the front sidebar-tack portion 60*a*; and a second bar-tack cam surface 39*d* that sets a zero feed amount at the rear side bar-tack portion 60*c*.

A feed control contact 50 is provided that is subject to consistent engagement with the cam surfaces 39*a* to 39*d* of the feed control cam 39. The swing of the feed control contact 50 is transmitted to the feed activating lever 51 and the vertical movement of the feed activating lever 51 is converted to the cloth feed amount of the feed dog by the feed regulator which converted amount is the feed amount of each stitch on the cloth. The cloth feed mechanism inclusive of the regulator is also publicly known by Japanese Patent Publication 2006-12284 A.

Referring to FIG. 8, a clutch lever 53 is pivoted to the front face of the feed control cam 39 by a support pin 54. The clutch lever 53 has an engagement portion 53*a* projecting outward relative to the cam surface of the feed control cam 39 at a substantial central portion thereof and an engagement finger 53*b* removably engaged with the clutch groove 37*a* of the clutch cam 37 at one end thereof. A torsion spring 55 wound on the support pin 54 urges the clutch lever 53 in the direction to bring the engagement finger 53*b* in engagement with the clutch groove 37*a*.

Figure 3:
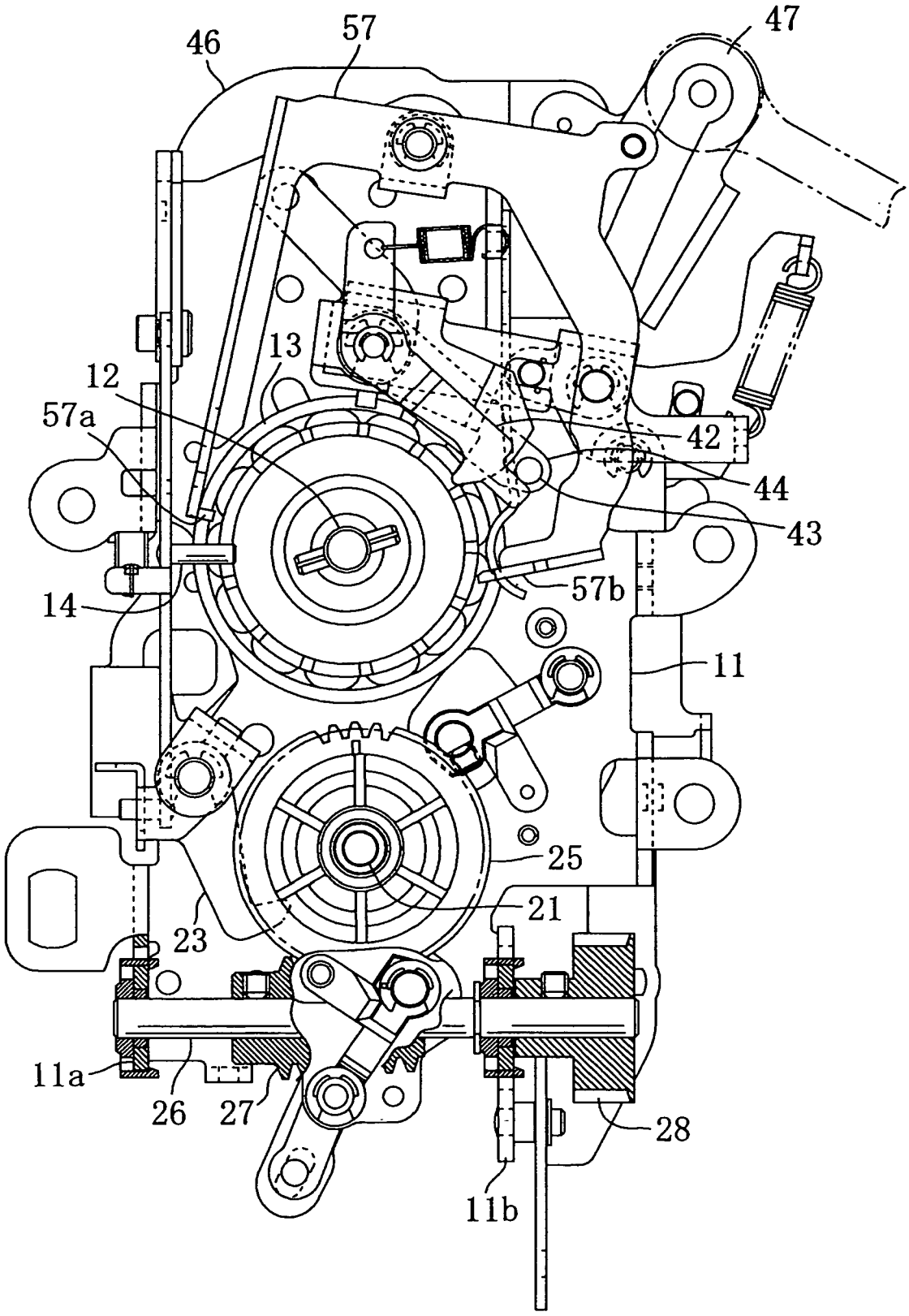
FIG. 3 is a vertical sectional rear view of the pattern generating mechanism.

Referring to FIGS. 2, 3 and 5 for further explanation of the clutch lever 53, a substantially U-shaped switch lever 57 is rotatably supported by the unit frame 11 and first and second engagement portions 57*a* and 57*b* are formed at the distal ends of the switch lever 57. In accordance with well-known zigzag sewing machines in the art capable of button-hole sewing, the engagement finger 53*b* and the clutch groove 37*a* are disengaged when either of the first or the second engagement portions 57*a* and 57*b* are placed in engagement with the engagement portion 53*a* by positional switching of the switch lever 57 operated conjunctively with the position detection lever used upon button-hole sewing.

However, when neither of the first or second engagement portions 57*a* and 57*b* is engaged with the engagement portion 53*a*, the engagement finger 53*b* of the clutch lever 53*b* is placed in engagement with the clutch groove 37*a* by the elastic force of the torsion spring 55, thereby linking the feed control cam 39 and the clutch cam 37 and consequently rotating the feed control cam 39, the first needle swing control cam 40 and the second needle swing control cam 41 integrally with the second follower gear 20.

Next, a description will be given on the operation of the pattern generating mechanism 10 having the above described configuration. When the pattern selection cam 13 is rotated to the button-hole sewing position by the pattern selection dial 16 to select button-hole sewing, the needle swing contact 23 is moved away from the needle swing cam 22*a* for utility sewing and moved to the position corresponding to the recess cam 22*b* of the needle swing cam group 22, consequently disabling the needle swing control of utility patterns.

Also, as described in patent document 1, the switch lever 57 is switched to a first rotary position by preparatory operation for button-hole sewing well-known in sewing machines of this type. In the first rotary position, the first engagement portion 57*a* engages with the engagement portion 53*a* of the clutch lever 53 to remove the engagement finger 53*b* of the clutch lever 53 from the clutch groove 37*a* to render a clutched-off state, thereby preventing the rotation of the second follower gear 20 from being transmitted to the feed control cam 39 and the first needle swing cam 40.

In this state, when the user rotates the switch lever 57 to a button-hole sewing start position via the button-hole position detection lever, the first engagement portion 57*a* is disengaged from the engagement portion 53*a* of the clutch lever 53 and arranges the clutch lever 53 to be engagable with the clutch groove 37*a* by the spring force of the torsion spring 55.

Thereafter, the main shaft 5 that drives the sewing machine M is rotated and the drive gear 27, the first follower gear 25, the second follower gear 20 and the lower shaft 8 are rotated by the timing belt 34. Thus, the clutch cam 37 and the second needle swing control cam 41 are rotated integrally with the second follower gear 20. Consequently, at a certain rotational position of the clutch cam 37, the clutch lever 53 provided on the feed control cam 39 engages with the clutch groove 37*a*, thereby causing the rotation of the combination cam 38, that is, the feed control cam 39 and the first needle swing control cam 40. This is a state where the clutch cam 37, the feed control cam 39, the first needle swing control cam 40 and the second needle swing control cam 41 are integrally rotated by the second follower gear 20. Thus, the feed control contact 50 is engaged with the first bar-tack cam 39*c* from the forward feed cam surface 39*b* of the feed control cam 39, thereby transmitting the swing of the feed control contact 50 to the feed activating lever 51 and rendering the regulator to set the feed amount to zero.

Also, the integral rotation of the cams 39 to 41 places the needle swing contact 42 in engagement with the second bar-tack cam surface 40*d* in a convex-concave profile from the swing-width halving cam surface 40*b* of the first needle swing control cam 40. Thus, the needle swing contact 42 only follows the convex-concave profile of the second bar-tack cam surface 40*d* so that six stitches from the third stitch (inclusive of the third stitch) is swung in a full swing range. Therefore, the needle bar 6 is swung in the full swing range and the front side bar-tacking portion 60*a* of the button-hole stitch 60 is formed on the workpiece cloth with the feed amount set to zero.

As described above, upon completion of forming the front side bar-tacking portion 60*a* by predetermined count of stitches (six stitches), that is, when the clutch cam 37, the feed control cam 39 and the first needle swing control cam 40 and the second needle swing control cam 41 are integrally rotated by 180°, the engagement portion 53*a* of the clutch lever 53 is engaged with the second engagement portion 57*b* of the switched switch lever 57 and the engagement finger 53*b* of the clutch lever 53 is disengaged from the clutch groove 37*a* (clutched off). As a result, the rotation of the feed control cam 39 and the first needle swing control cam 40 are stopped while the second needle swing control cam 41 continues its rotation.

In this state, the feed control contact 50 is transferred from the feed control cam 39 of the first bar-tack cam 39*c* to the reverse feed cam surface 39*a* for engagement therewith and such change undertaken by the feed control contact 50 activates the feed regulator and reverses the movement of the feed dog.

At the same time, the needle swing contract 42 is transferred to a state establishing engagement with the swing-width halving cam surface 40*a* of the first needle swing control cam 40 which state rotates only the second needle swing control cam 41 on the eccentric shaft 38*a* integrally with the second follower gear 20 and the needle swing contact 42 is swung within the range limited by the mating of the swing-width halving cam surface 40*a* of the first needle swing control cam 40 and the convex portion of the cam surface 41*a* of the second needle swing control cam 41. Thus, the needle bar 6 is swung in the left-half portion of the full swing range to form the left side over-edging portion 60*b* of the button-hole stitch 60 in reverse feed.

As described above, when the left side over-edging portion 60*b* of predetermined length capable of receiving the button is formed by reverse feeding the workplace cloth, the rotation of the switch lever 57 in conjunction with the button-hole position detection lever moves the second engagement portion 57*b* away from the feed control cam 39 to be disengaged from the engagement portion 53*a* of the clutch lever 53 and is brought in engagement with the clutch groove 37*a* again.

Thus, the clutch cam 37, the feed control cam 39, the first needle swing control cam 40 and the second needle swing control cam 41 are placed in condition to be integrally rotated again and the feed control contact 50 is engaged with the second bar-tack cam surface 39*d* from the reverse feed cam surface 39*a* of the feed control cam 39 so that the feed regulator sets the feed amount to zero.

Also, the integral rotation of the cams 39 to 41 brings the needle swing contact 42 in engagement with the first bar-tack cam surface 40*c* in a convex-concave profile from the swing-width halving cam surface 40*a* of the first needle swing control cam 40 and the needle swing contact 42 only follows the convex-concave profile of the first bar-tack cam surface 40*c* and swung for six stitches in full swing range. Thus, the needle bar is swung in full swing range to sew the rear side bar-tack portion 60*c* in predetermined count of stitches (six stitches) on the workpiece cloth with feed amount set to zero.

As described above, after forming the rear side bar-tack portion 60*c*, that is when the clutch cam 37, the feed control cam 39, the first needle swing control cam 40 and the second needle swing control cam 40 are integrally rotated by 180°, the engagement portion 53*a* of the clutch lever 53 is engaged with the first engagement portion 57*a* of the switch lever 57 and the engagement finger 53*b* of the clutch lever 53 is disengaged from the clutch groove 37*a*. As a result, the rotation of the feed control cam 39 and the first needle swing control cam 40 are stopped.

In this state, the feed control contact 50 is transferred from the second bar-tack cam 39*d* to the forward feed cam surface 39*b* for engagement therewith and the feed regulator is activated to switch the feed dog to forward feed.

In this state, only the second needle swing control cam 41 is rotated on the eccentric shaft 38*a* integrally with the second follower gear 20 and the needle swing contact 42 is swung within the range limited by the mating of the swing-width halving cam surface 40*b* and the convex portion of the cam surface 41*a* of the second needle swing control cam 41. Thus, the needle bar 6 is swung in the right-half portion of the full swing range to form the right side over-edging portion 60*d* of the button-hole stitch 60 in forward feed. Thereafter, when the right side over-edging portion 60*d* is connected with the front side bar-tack portion 60*a*, one cycle of button-hole sewing is completed.

As can be understood from the embodiment, the pattern generating unit of a sewing machine generating stitch patterns by mechanical motion described in the present disclosure includes a pattern selection cam 13 for selecting a pattern from a plurality of utility patterns by a pattern selection dial 16 and a needle swing cam group 22 that generate swinging movement of a needle bar 6 in accordance with a plurality of utility patterns to enable selective formation of utility patterns. Further, the disclosed pattern generating unit of a sewing machine includes a feed control cam 39 serving as a button-hole cam 18 for forming button-hole stitches; and a drive gear 27, first and second follower gears 25 and 20 for driving first and second needle swing cams 40 and 41; thus is capable of selective execution of button-hole sewing.

Such configuration is characterized in that the button-hole cam 18 is provided on a pattern selection cam shaft 12 of a compact pattern selection cam 13 instead of providing the same co-axially with a pattern cam shaft 21 of the needle swing cam group 22. Axial dimensions of the pattern selection cam 13 and the button-hole cam 18 are essentially less by nature of their functionality as compared with the axial dimensions of the needle swing cam group 22 for forming utility patterns. Thus, the above described configuration of disposing the pattern selection cam 13 and the button-hole cam 18 co-axially reduces the longitudinal width of the arm 3 as compared with the conventional configuration in which the button-hole cam 18 and the needle sewing cam group 22 are disposed co-axially, thereby allowing the size reduction of the sewing machine.

Since only three gears, namely the drive gear 27, the first follower gear 25 and the second follower gear 20 are required to transmit rotation of the main shaft 5 induced by the sewing machine motor, considerable amount of gears can be reduced as compared with the configuration described in patent document 2. Thus, the drive mechanism is simplified to realize a compact pattern generating mechanism 10. Also, since gear engagement has been withheld to three engagements, there is very little backlash and precision of rotational positioning of the needle swing cam group 22 and the button-hole cam 18 is improved.

The drive gear 27, the first follower gear 25 and the second follower gear 20 are constituted by a warm gear, a worm wheel, and a helical gear respectively. Use of such low cost parts allows low manufacturing cost.

The reduction ratio of the first reduction mechanism 30 composed of the drive gear 27 and the first follower gear 25 is set at 1/12, and the reduction ratio of the second reduction mechanism 31 composed of the first reduction mechanism 30 and the first and the second follower gears 25 and 20 is arranged to amount to a total of 1/18, the needle swing cam group 22 can be formed as small cams of 12 divisions whereas the button-hole cam can be formed as a general eighteen division cam without being constrained by twelve division.

The drive gear 27, the first follower gear 25 and the second follower gear 20 are vertically disposed in the listed sequence in a substantially linear arrangement. Such organized arrangement improves the ease in installing the drive mechanism.

The present invention is not limited to the foregoing description but can be modified as follows.

The reduction ratio of first reduction mechanism 30 composed of the drive gear 27 and the first follower gear 25, and the total reduction ratio of the second reduction mechanism 31 composed of the first reduction mechanism 30 and the first and the second follower gears 25 and 20 may be set to any value in accordance with the number of divisions applied to the needle swing cam group 22 and the button-hole cam 18 used. Also, a switch mechanism with no clutch mechanism may be employed instead of the use of clutch mechanism such as a clutch cam 37 for switching the sewing operation for the left-right over-edging portion and the bar-tack portion.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

What is claimed is:

1. A pattern generating mechanism of a sewing machine including a main shaft, a pattern needle swing cam group rotating in synchronism with the main shaft and composed of cams corresponding to each of a plurality of patterns, a pattern cam shaft supporting the pattern needle swing cam group, and a pattern selection cam capable of being manually operated to select a desired cam from the pattern needle swing cam group to generate needle swing movement for a utility pattern selected by the pattern selection cam, the pattern generating mechanism of a sewing machine, comprising:

a pattern selection cam shaft provided independently of the pattern cam shaft and having the pattern selection cam mounted thereon;

a button-hole cam mounted on the pattern selection cam shaft and generating a needle swing movement and a cloth feed movement for button-hole sewing;

a drive gear rotated by rotation of the main shaft;

a first follower gear engaging with the drive gear to rotate the needle swing cam group; and a second follower gear engaging with the first follower gear to rotate the button-hole cam.

2. The mechanism of claim 1, wherein the drive gear is a worm gear, the first follower gear is a worm wheel, and the second follower gear is a helical gear.

3. The mechanism of claim 2, wherein a reduction ratio of a first reduction mechanism composed of the drive gear and the first follower gear is 1/12 and total reduction ratio of a second reduction mechanism composed of the first reduction mechanism and the first follower gear and the second follower gear is 1/18.

4. The mechanism of claim 2, wherein the drive gear, the first follower gear, and the second follower gear are disposed in listed sequence in a substantially linear arrangement.

5. The mechanism of claim 1, wherein a reduction ratio of a first reduction mechanism composed of the drive gear and the first follower gear is 1/12 and total reduction ratio of a second reduction mechanism composed of the first reduction mechanism and the first follower gear and the second follower gear is 1/18.

6. The mechanism of claim 5, wherein the drive gear, the first follower gear, and the second follower gear are disposed in listed sequence in a substantially linear arrangement.

7. The mechanism of claim 1, wherein the drive gear, the first follower gear, and the second follower gear are disposed in listed sequence in a substantially linear arrangement.

* * * * *